United States Patent [19]

Roba

[11] Patent Number: 4,778,142

[45] Date of Patent: Oct. 18, 1988

[54] AWNING ANCHOR

[76] Inventor: John D. Roba, 359 Ayer Rd., Williamsville, N.Y. 14221

[21] Appl. No.: 71,866

[22] Filed: Jul. 10, 1987

[51] Int. Cl.[4] ..... F16M 13/00

[52] U.S. Cl. ..... 248/545; 52/157; 248/156; 248/508; 248/530; 403/408.1

[58] Field of Search ..... 248/545, 530, 156, 532, 248/533, 357, 508; 403/408.1; 52/157; 411/338, 339, 546

[56] References Cited

U.S. PATENT DOCUMENTS

| | | | |
|---|---|---|---|
| 989,386 | 4/1911 | Miller | 248/156 |
| 2,210,048 | 8/1940 | Swanson | 411/338 |
| 2,569,528 | 10/1951 | Kandle | 52/157 X |
| 3,318,560 | 5/1967 | Garrette, Jr. et al. | 248/532 X |
| 3,327,724 | 6/1967 | Nielsen | 160/46 X |
| 3,698,144 | 10/1972 | Stratton | 52/157 X |
| 3,720,438 | 3/1973 | Johnson et al. | 160/46 X |
| 4,301,851 | 11/1981 | Gitkin | 160/46 |
| 4,593,872 | 6/1986 | Svensson | 248/530 X |
| 4,684,097 | 8/1987 | Cox | 248/357 X |

*Primary Examiner*—Ramon S. Britts
*Assistant Examiner*—David L. Talbott
*Attorney, Agent, or Firm*—James J. Ralabate

[57] ABSTRACT

An anchor for holding an awning in position. The anchor includes at least one auger and one bracket. The auger is screwed into the ground leaving exposed an upper section which has an eye portion. The bracket is a U-shaped bracket which is adapted to fit over and attach to the eye portion of the auger. The bracket is adapted to accommodate viarous sizes of awning post.

11 Claims, 1 Drawing Sheet

AWNING ANCHOR

This invention relates to awning anchors and, more specifically, to a novel awning tie down system.

BACKGROUND OF THE INVENTION

Protective coverings have become popular for use in the outer portions of houses, trailers and other more permanent structures. A common covering used is an awning which is secured on its upper end to the upright wall of the structure and on its lower end portions to the ground. It is important for several reasons to provide strudy attachments for both ends of the awning in the event of high winds, rain storms or the like. Since the awning is usually utilized in exposed, outside portions of a structure, it becomes even more vulnerable to the elements. There is a need for anchor systems or an attachment system that provides maximum stability to these type protective coverings. While protective coverings will be referred to as "awnings" throughout this disclosure, it is understood that awnings is intended to include any type of protective coverings such as aluminum, glass fiber, wood or any other material covering.

There are known several systems for anchoring protective coverings to the ground. In U.S. Pat. No. 3,327,724 (Nielsen) a system is disclosed wherein a flexible hold down member is attached to the leading bottom edge of a protective covering and to the ground. Upright supports or pegs are pushed or screwed into the ground and ropes are connected to the pegs and the bottom edge of the covering. The rope is threaded through a washer in the pegs and wound around the pegs for security and stability. The rope is then tightened by the use of a spring loaded washer secured to the peg. This system depends to a great extent on the durability of the rope used and its ability to maintain its conditions and tautness. If, for example, the rope stretches when wet, it could cause the support to become loose and insecure. In addition, the Nielsen system uses a skewer type stake that is placed in the ground between the awning poles where the ropes are attached to the top of the poles and down to the skewer. A stronger and more secure system would provide for attachemnt directly to the bottom of a foot plate at the end of an awning arm. In addition, the use of ropes can be hazardous or unsafe, especially at night when they are not easily seen and where someone can trip or fall over them.

In U.S. Pat. No. 3,720,438 to Johnson, et al., a system is disclosed wherein foot pieces are used to hold the awning support poles in a vertical position. In his system, foot pieces are placed on the ground and nails, stakes or rods are driven through apertures in these foot pieces into the ground. The vertical supporting pole is then secured to the foot piece to provide an upright support for the awning. These foot pieces can be easily dislodged or pulled free from the ground in that the nails attaching them to the ground have no means to provide resistance to uprooting or dislodging.

In U.S. Pat. No. 4,301,851 (Gitkin), an awning system is disclosed wherein a combined movable shutter and awning is utilized. The shutter is a roller shutter capable of extension and retraction movable between positions providing a closure for a door assembly or the like. Gitkin also teaches if the area over which the awning is supported is grass or soil, the lower ends of the supports posts may be provided with a pointed ground inserting member. This inserting member has a horizontal flange spaced from the pointed end thereof to limit the insertion into the ground surface and facilitates the insertion by use of a plate on which a foot is placed. The foot is then pressed down so that the pointed end of the support post can be driven into the ground. Also Gitkin suggests the use of some type of locking device between the lower end of the post and the patio deck or ground such that a positive anchor is provided. While Gitkin recognizes the problem of securing a support post to the ground, he does not specifically provide a system to solve the problem, but rather suggests "by any of various conventional structures".

There is therefore a need to provide a system for securely and safely anchoring an awning structure to the ground.

SUMMARY OF THE INVENTION

It is therefore an object of this invention to provide an awning tie down system or kit devoid of the above noted prior art disadvantages.

Another object of this invention is to provide a stronger and more secure system for attaching an awning structure to the ground or other support surface.

A further object of this invention is to provide an awning tie down system or kit that is substantially less hazardous than previously used systems.

A yet further object of this invention is to provide an awning tie down system that is relatively uncomplicated and easy to install.

Still a further object of this invention is to provide an improved anchoring system for an awning that is relatively simple and inexpensive.

These and other objects of this invention are accomplished, generally speaking, by providing an awning anchoring kit or system comprising an auger that is screwed into the ground. In the alternative, an eye bolt can be used for insertion into a hard surface like concrete or cement. In this case an auger is used without need for the helical portion hereinafter described. At the top portion of the auger is an eye or opening that is exposed above the ground after the auger has been screwed in place. A bracket having an inverted U-configuration is placed over the eye and a bolt extended through both vertical walls of the bracket and through the eye. A pin or other securing means is used to secure the bolt in place. At the top horizontal surface of the bracket are positioned apertures to receive a bolt or other securing means used to attach the awning support post or awning arm thereto. Since the eye of the auger is substantially larger than the diameter of the bolt, a plastic spacer or roller is tightly fit into or placed through the eye and the bolt extended through the central portion of the roller. The use of spacer or the roller is important because it enables the arm to be attached to the anchor so that there is absolutely no vertical movement of the arm during adverse weather conditions. The outer circumference of the roller fits tightly into the eye of the auger.

To use the kit or system of this invention, the augers are placed in the ground where the awning arm would come down in a patio position. The plastic roller is then placed through the eye of the auger. An aluminum (or other suitable material) bracket is then attached to the end of the awning arm with the carriage bolts, flat washers and wing nuts.

The awning arm is then brought back down to meet the auger. A pin is then placed through the aluminum bracket and plastic spacer or roller, and the lock pin is then placed through the pin to hold securely in place.

BRIEF DESCRIPTION AND PREFERRED EMBODIMENT

DESCRIPTION OF DRAWING AND PREFERRED EMBODIMENT

Figures 1, 2, 3:
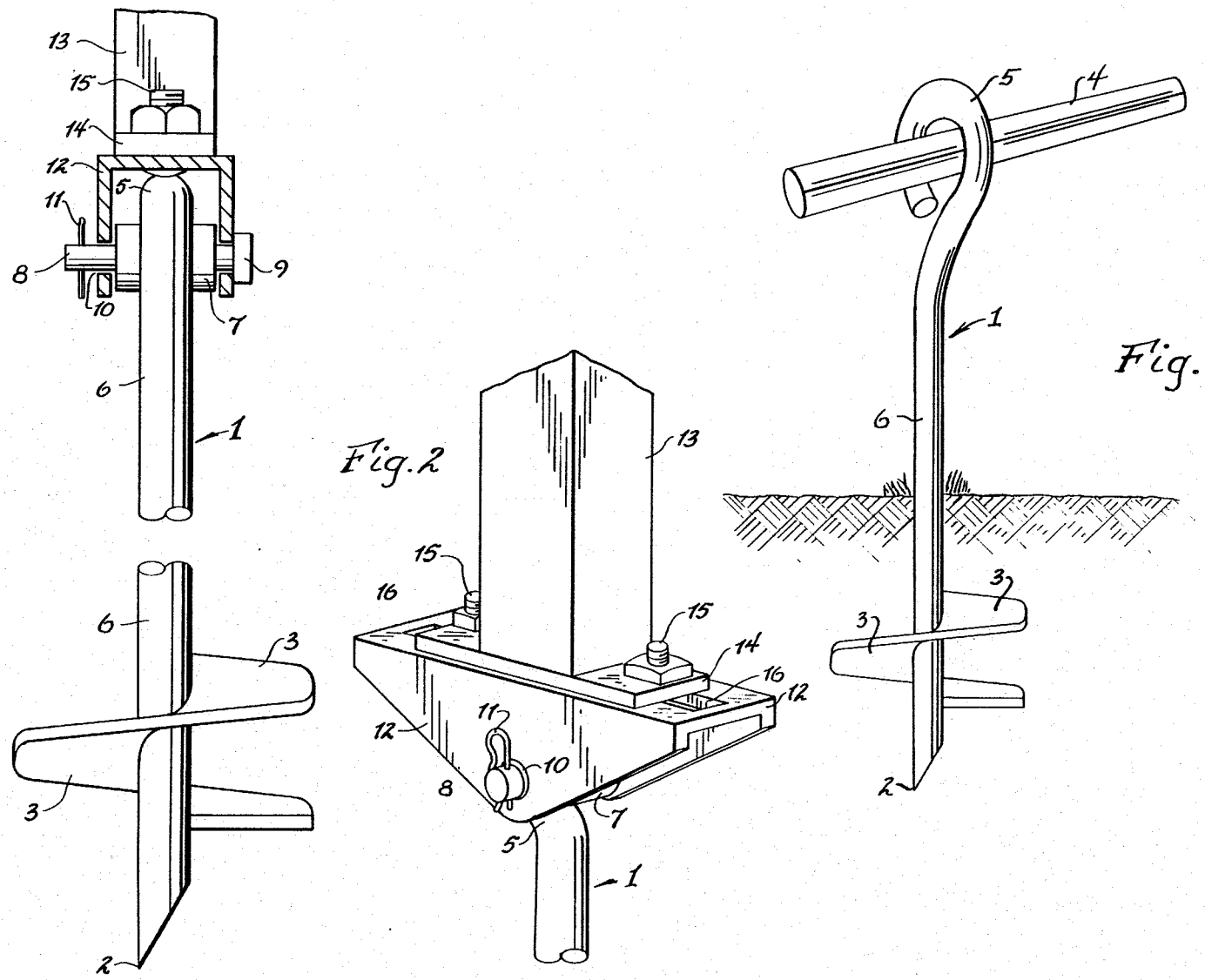
FIG. 1 is a side plan view of the auger, bracket, spacer or roller and awning arm after attachment.
FIG. 2 is a perspective view showing auger after in place in ground with bracket and awning arm attached to it.
FIG. 3 is a perspective view showing auger of this invention being screwed into the ground.

In FIG. 1, an auger 1 is shown having a pointed end 2 and immediately above said end 2 is a helical portion 3. With pointed end 2, the auger is easily pushed into the ground and auger 1 turned or rotated to screw helical portion 3 deeper into the ground. The auger 1 is rotated by turning handle means 4 until just eye portion 5 remains above the ground surface. Turning handle means 4 (see FIG. 3) can be any sturdy bar or rod that will fit into eye portion 5 to assist in screwing auger 1 into the ground. The auger may be constructed of wrought iron or steel; however any suitable material may be used. Helical portion 3 may be of any convenient dimensions, as long as it easily screws into ground and forms a firm hold or anchor. As discussed earlier, if it is desired to place the place auger 1 in a hard surface like cement, concrete, asphalt or the like, then there is no necessity to have a helical portion. When the term "auger" is used throughout this disclosure, it includes eye-bolts without the helical portion. The stem 6 of auger 1 may be of any suitable length or thickness depending upon the strength desired in each particular case. In the eye portion 5 at top of auger 1 is inserted a nylon spacer or roller 7 through which bolt 8 is extended. Bolt head 9 extends out from bolt 8 after bolt 8 has passed through bracket hole 10 and through roller 7. It is important to use spacer or roller 7 because it prevents vertical movement of the arm 13 during adverse weather conditions. The outer peripheral portion of roller 7 fits tightly into the interior of eye portion 5. Bolt head 9 is at one end of bolt 8 and at the opposite end of bolt 8 is an aperture through which pin 11 is secured to lock bolt 8 in place (connecting bracket 12 to auger 1). Bracket 12 is thereby fixed on its lower end to auger 1 and at its upper end fixed to awning arm 13. Awning arm 13 has an L-shaped bottom portion forming a foot portion 14 through which bolts 15 are fixed, thereby securing arm 13 to the upper portion of bracket 12. The system as shown in FIG. 1 holds the awning down by attaching the end 14 of arms 13 to the auger 1 which is firmly implanted into the ground. It securely holds the awning in place and prevents damage from wind and rain. Bracket 12 is a universal bracket that will fit all awning arms.

In FIG. 2, the auger 1 is shown in the ground with eye portion 5 extending above the ground. The augers 1 are placed in the ground where the awning arm 13 would come down in a patio position. The plastic or nylon (or other suitable material) roller 7 or spacer 7 is then placed through the eye 5 of the auger 1. The V-shaped aluminum (or other suitable material) bracket 12 has an aperture 10 at its lower portion through which bolt 8 fits and is attached to auger 1. The bracket 12 has an inverted, U-shaped configuration when viewed from the end and a V-shaped configuration when viewed from the front. A pin or other securing means is used at the end of bolt 8 to fix in position. At the upper surface of bracket 12 are slots 16 through which carriage bolts 15 extend after passing through foot portion 14. The bolt 8 is then placed through the aluminum bracket 2 and plastic spacer 7, and the lock pin 11 is then placed through the bolt 8 end aperture to hold securely in place.

In FIG. 3, auger 1 is shown being screwed into the ground by pushing auger point 2 into the ground and turning auger 1 by rotating a handle means or turnrod 4 which is inserted into eye portion 5 of auger 1. As auger 1 is turned, spiral or helical means 3 is threaded into the ground continuously until the auger 1 is firmly implanted and only eye portion 5 remains visible above the ground. Spacer 7 is then tightly placed through the eye 5 and awning arm 13 is attached to bracket 12 and auger 1 as above described. It is important that bracket 12 be universally adapted to fit and accomodate any type awning arm or bottom portions of awning arms. Also, if a hard surface is used as the foundation (rather than the ground), an eye-bolt without the helical portion 3 is used rather than auger 1.

The preferred and optimumly preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. An anchor kit adapted to hold an awning and the like in position, said kit comprising at least one auger and at least one bracket, said auger has at one terminal portion a substantially pointed end and at the opposite terminal portion an eye section, said bracket being universally adapted to connect to any awning arm, said bracket when viewed from a side perspective having an inverted U-shaped configuration, said inverted U-shape comprising an upper horizontal surface and two side portions extending downwardly therefrom, said horizontal surface containing at least one slot to accommodate attachment of an awing arm thereto, said slot positioned in said horizontal upper surface and adapted to accommodate various size awning arms for attachment thereto, said bracket containing aligned apertures on each side of its lower inverted U-shaped sides, and having a hollow roller between said apertures, the center part of said roller in alignment with said apertures and said roller located through said eye section, said bracket adapted to be connected by a bolt to said eye section, said bolt extending sequentially through one of said apertures and through said roller, through to the aperture on an opposite side of said inverted U-shaped side.

2. The kit of claim 1 wherein said bracket when viewed from a front perspective has a V-shaped configuration with said aligned apertures positioned in the lower portion of said V-shaped configuration.

3. The kit of claim 1 wherein said bracket contains, between said inverted U-shaped sides said roller which has a hollow center, said hollow center positioned in horizontal alignment with said apertures.

4. The kit of claim 1 wherein siad auger comprises a vertically disposed helical portion located intermediate opposite end portions of said auger.

5. The kit of claim 1 wherein the slot on the upper horizontal bracket surface is adapted to receive at least one bolt connecting means for attaching an awning arm thereto.

6. The kit of claim 1 containing at least two augers and at least two brackets.

7. An anchor adapted to hold an awning in position comprising at least one auger and at least one bracket, said auger having at its lower end a pointed portion and at its opposite upper end an eye portion, said bracket when viewed from a side perspective having an inverted U-shaped configuration, said bracket fitting over said eye portion and having apertures on downward extending side portions said apertures in alignment with eye opening of said eye portion, a hollow roller positioned in said eye opening and also in alignment with said apertures, an attachment means extending through said roller and said apertures and fixed to said bracket adjacent said apertures, said bracket having an upper horizontal surface substantially parallel with the axis of said roller, said horizontal surface having at least on slot adapted to accommodate an attachment to any suitable size awning arm.

8. The anchor of claim 7 wherein said bracket when viewed from a front perspective has a V-shaped configuration with said aligned apertures positioned in the lower portion of said V-shaped configuration.

9. The anchor of claim 7 wherein said bracket contains, between said inverted U-shaped sides said roller which has a hollow center, said hollow center positioned in horizontal alignment with said apertures.

10. The anchor of claim 7 wherein said auger comprises a vertically disposed helical portion located intermediate opposite end portions of said auger.

11. The anchor of claim 7 wherein the slot on the upper horizontal bracket surface is adapted to receive at least one bolt connecting means for attaching an awning arm thereto.

* * * * *